United States Patent [19]

Helmick

[11] 4,064,593

[45] Dec. 27, 1977

[54] SLIDING DOOR ROLLER ASSEMBLY

[76] Inventor: B. J. Helmick, 303 Deborah Court, Upland, Calif. 91786

[21] Appl. No.: 737,475

[22] Filed: Nov. 1, 1976

[51] Int. Cl.[2] ..... A47H 15/00; E05D 13/02

[52] U.S. Cl. ..... 16/105; 49/420; 49/425; 16/99; 16/97

[58] Field of Search ..... 16/49, 82, 97, 99, 100–103, 16/105, 106; 49/421, 425, 420

[56] References Cited

U.S. PATENT DOCUMENTS

| | | | |
|---|---|---|---|
| 3,090,084 | 3/1963 | Banner | 16/100 |
| 3,175,255 | 3/1965 | Saunders | 16/100 |
| 3,283,444 | 11/1966 | Andres | 16/99 X |
| 3,670,357 | 6/1972 | Steigerwald | 16/100 |
| 3,698,036 | 10/1972 | Goodman | 16/100 |
| 3,722,028 | 3/1973 | Schoenbrod | 16/97 |
| 3,731,431 | 5/1973 | Banner | 16/99 |
| 3,774,342 | 11/1973 | Thom | 16/99 |
| 3,879,893 | 4/1975 | Helmick | 16/99 X |
| 3,959,849 | 6/1976 | Marquardt | 16/105 |

*Primary Examiner*—Ronald Feldbaum
*Attorney, Agent, or Firm*—Boniard I. Brown

[57] ABSTRACT

A supporting roller assembly for a sliding door has a downwardly spring loaded guide track engaging roller supported for vertical floating movement by a mounting bracket containing a limited stop plunger which is spring loaded downwardly against the roller carrier. The bracket is slotted and carries a clamp screw accessible from the side of the door for clamping the bracket firmly about the plunger to secure the plunger in a fixed position for limiting upward movement of the guide roller against the action of its spring.

6 Claims, 7 Drawing Figures

SLIDING DOOR ROLLER ASSEMBLY

BACKGROUND OF THE INVENTION

1. Field of the Invention

This invention relates generally to sliding doors and more particularly to a novel bottom guide roller assembly for such sliding doors.

2. Prior Art

At the outset, it is important to note that the guide roller assembly of this invention may be utilized on a variety of sliding doors and other sliding closures which are collectively referred to herein simply as sliding doors. The invention, however, is intended primarily for use on sliding glass doors of the type used as patio doors in private dwellings and the like. For this reason, the invention will be described in the context of such sliding glass doors.

Sliding glass doors of the kind referred to are well known and comprise a rectangular metal frame to be fixed within a door opening in a wall and at least a pair of relatively movable door panels mounted within the frame. One of these panels is generally a fixed panel which is securely fastened to the frame and occupies only a portion of the frame opening so that the remainder of the frame opening provides an access opening through the frame. The other panel of the door assembly is a movable panel which is supported within the frame for edgewise sliding movement to and from a closed position wherein the panel closes the access opening. In its open position, the movable panel overlaps the stationary panel and uncovers the access opening for free passage of persons therethrough.

The movable door panel is supported at its bottom on a track extending along the bottom of the door frame by means of roller assemblies mounted within a downwardly opening channel along the lower edge of the door panel. Each roller assembly has a peripherally grooved roller which rides in the track and is supported for vertical floating movement on a mounting bracket which is fixed within the bottom door channel. The roller carrier is spring loaded downwardly toward the track so as to yieldably retain the roller in proper guiding contact with the track in the event that the sliding door panel is inadvertently elevated away from the track during opening and closing movement thereof.

A vast assortment of such sliding door roller assemblies have been devised. One such roller assembly is described in my prior U.S. Pat. No. 3,879,893. Other roller assemblies are described in U.S. Pat. Nos. 3,090,084, 3,698,036, and 3,722,028.

Sliding door supporting roller assemblies of the character described requires some means of transferring the weight of the sliding door to the assembly rollers. This is generally accomplished by some type of a limit stop arrangement operative between the guide roller carrier and the roller mounting bracket. In my prior U.S. Pat. No. 3,879,893, for example, the limit stop is a vertical plunger which is slidable in the guide roller mounting bracket and surrounded by a spring for urging the plunger downwardly toward the roller carrier. Threaded in the mounting bracket is a set screw which is accessible through an opening in the side of the sliding door, whereby the screw may be tightened to clamp the limit stop plunger in fixed position relative to the mounting bracket. The roller assembly, when installed on a sliding door, is set by elevating the door to raise its bottom edge out of contact with the bottom of the door frame, then releasing the limit stop screws to permit downward spring projection of the limit stops into contact with the guide roller carriers, and finally tightening the screws to lock the limit stops in fixed position. When the sliding door is then released, the weight of the door is transmitted through the limit stop, the guide roller carriers, and the guide rollers to the guide track on the door frame.

This roller assembly of my prior patent is superior to those of the other listed patents for the reason that proper setting or adjustment of my patented roller assemblies may be easily accomplished from the sides of the door. This is due, of course, to the accessibility of the limit stop clamp screws through the side openings in the door. The other patented roller assemblies referred to lack comparable adjustment accessibility and hence are much more difficult to adjust or set.

SUMMARY OF THE INVENTION

This invention provides improved sliding door supporting roller assemblies of the character described which retain the roller adjustment accessibility and ease discussed above in connection with my prior U.S. Pat. No. 3,879,893, and are characterized by somewhat greater simplicity of construction and economy of manufacture. To this end, the present improved roller assemblies include a spring loaded limit stop plunger similar to that of my prior patent. In contrast to the limit stop securing arrangement of my prior patent, however, the roller mounting bracket is slit in a plane containing the plunger axis to form a pair of resilient clamp arms straddling the plunger. These clamp arms are joined by a clamp screw which is accessible through a side opening in the sliding door. In the present improved roller assemblies, therefore, the spring loaded limit stop plunger is fixed in position by tightening the mounting bracket clamp screw to draw the bracket clamp arms toward one another and thereby clamp the plunger between the arms. The limit stop plunger is released for free axial adjustment by loosening the mounting bracket clamp screw.

Several presently preferred embodiments of the invention are described. Certain of these embodiments utilize a basic roller structure similar to that of my prior patent. Another described embodiment utilizes a basic roller structure similar to that described in U.S. Pat. No. 3,698,036.

DESCRIPTION OF THE PREFERRED EMBODIMENTS

Figure 1:
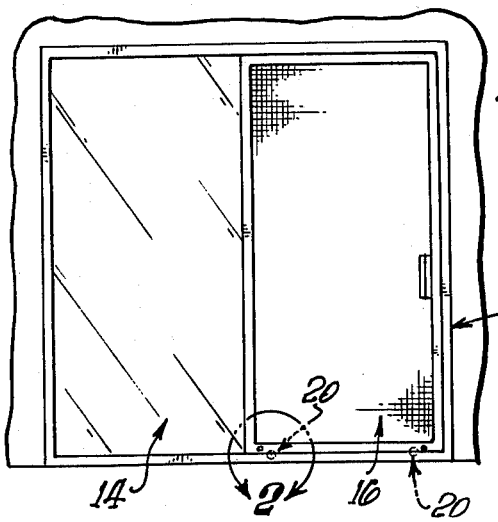
FIG. 1 is a side elevation of a sliding door assembly embodying improved sliding door supporting rollers of the present invention.

FIG. 1 illustrates a sliding door assembly 10 including a frame 12 defining a door opening containing glass door panels 14 and 16. Door panel 14 is a fixed panel which is removably secured to the door frame 12 and occupies approximately one-half of the frame opening. Door panel 16 is a movable panel which is movable relative to the door frame 12 between its closed position of FIG. 1 and an open position, wherein the panel is disposed alongside the fixed panel 14. In its open position, the movable panel 16 uncovers approximately one-half of the opening through the door frame 12 to provide an access opening through the frame.

Extending along the bottom member of the door frame 12 is an upstanding track 18. The movable door panel 16 is supported on this track for opening and closing movement by means of a pair of door supporting roller assemblies 20 according to the invention. The two roller assemblies 20 are identical and will now be described in detail by reference to FIGS. 2 through 4 which illustrate one of the roller assemblies.

Roller assembly 20 comprises a generally L-shaped mounting bracket 22 including a normally upper generally block-like arm 24 and a narrower depending arm 26. Pivotally attached at one end to the lower end of the bracket arm 26, by means of a pivot pin 28, is a roller carrier arm 30 rotatably mounting at its opposite end a peripherally grooved roller 32. The roller carrier arm 30 has a channel-like construction and straddles both the bracket arm 26 and the roller 32. Secured to and extending from the pivoted end of the roller arm 30 is an arcuate leaf spring 34.

A limit stop plunger 36 is slidable within a bore 38 in the upper arm 24 of the roller mounting bracket 22. Surrounding the lower end of this plunger is a coil spring 40 which seats at its lower end against an enlarged head 42 on the plunger and at its upper end against the bracket arm 24. This spring urges the limit stop plunger 36 downwardly against the roller arm 30, as shown best in FIGS. 2 and 4.

As thus far described, the sliding door roller assembly 20 is essentially identical with that described in my prior U.S. Pat. No. 3,879,893 and is installed in the sliding door panel 16 in the same manner as my patented roller assembly. Thus, the roller assembly 20 is mounted within a channel 44 which extends along the lower edge of the sliding door panel 16 and opens downwardly through an opening 46 in the bottom channel wall. The mounting bracket arm 34 seats upwardly against the upper wall of the channel 44 and the roller 32 projects through the channel opening 46 for engagement with the door frame track 18. As noted earlier, roller 32 is peripherally grooved to receive the upper edge of the track. The roller assembly spring 34 bears on the bottom wall of the door channel 44 at one side of the channel opening 46 and serves to bias the roller 32 downwardly into engagement with the frame track 18.

The purpose of the roller assembly limit stops 36 is to transmit the weight of the sliding door panel 16 to the roller assembly rollers 32 and thence to the frame trach 18. To this end, the limit stops 36 are so adjusted that the weight of the sliding door panel 16 is supported on the roller arms 30 through the limit stops. Adjustment of the limit stops to accomplish this end is accomplished in the same manner as described earlier by retaining the sliding door panel 16 in a slightly elevated position, wherein its lower edge is raised out of contact with the bottom of the door frame 12 while the rollers 32 are retained in contact with the frame track 18 by the downward pressure of the limit stop springs 40 and then securing the limit stops in fixed position relative to their roller mounting brackets 22. When the sliding door panel 16 is then released, the entire weight of the panel is transmitted to or supported on the frame track 18 through the limit stops 36, the roller arms 30 and the rollers 32.

The primary contribution of the present invention resides in the means for releasibly securing the limit stop 36 of each supporting roller assembly 20 in fixed position relative to the assembly bracket 22. According to the invention, this is accomplished by slitting the upper bracket arm 24 in a plane containing the axis of the plunger receiving board 38 in the arm, as illustrated at 48 in FIG. 3. This slit 48 divides the upper mounting bracket arm 24 into a pair of resilient clamp arms 50 which effectively straddle the limit stop plunger 36 when positioned in the bracket bore 38. The bracket clamp arms 50 are joined by a screw 52 which extends loosely through a hole 54 in one clamp arm and is threaded in the other clamp arm. Accordingly, rotation of the screw 52 in one direction draws the clamp arms 50 toward one another to firmly grip the limit stop plunger 36 between the arms and thereby clamp the plunger against axial movement relative to the roller mounting bracket 22. Rotation of the screw 32 in the opposite direction releases the limit stop plunger for free axial movement relative to the mounting bracket.

The roller assembly 20 is installed in the bottom door channel 44 in the manner explained earlier with the upper arm 24 of the roller mounting bracket 22 seating against the upper wall of the channel. The clamp screw 52 of the roller assembly extends through a hole in one side wall of the door channel 44, as shown best in FIG. 4. Accordingly, the screw 52 serves the dual purpose of a mounting screw for retaining the roller assembly in the door channel 44 and a clamp screw for releasibly clamping the limit stop plunger 36 to the roller mounting bracket 22.

When adjusting each roller 20 in the manner described earlier, the movable door panel 16 is elevated out of contact with the bottom of the door frame 12, as explained, and the roller assembly clamp screws 52 are released to permit downward spring projection of the limit stop plungers 36 against their respective roller arms 30 to retain the rollers 32 in contact with the frame track 18. The clamp screws 52 are then tightened to firmly lock the limit stops 36 to the roller mounting brackets 22. Accordingly, when the movable door panel 16 is released, the entire weight of the panel is supported on the frame track 18 through the roller assemblies 20.

Figure 3:
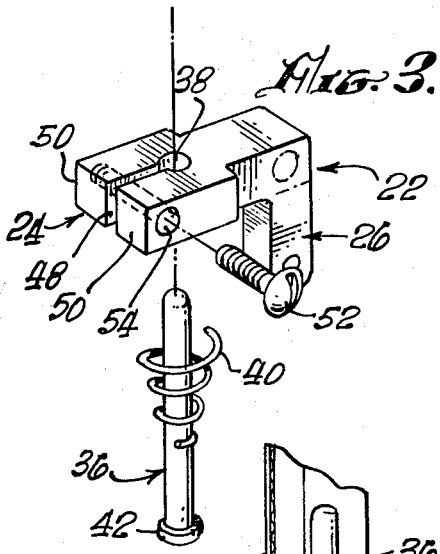
FIG. 3 is a fragmentary exploded perspective view of the roller assembly illustrated in FIG. 2.
Figure 2:
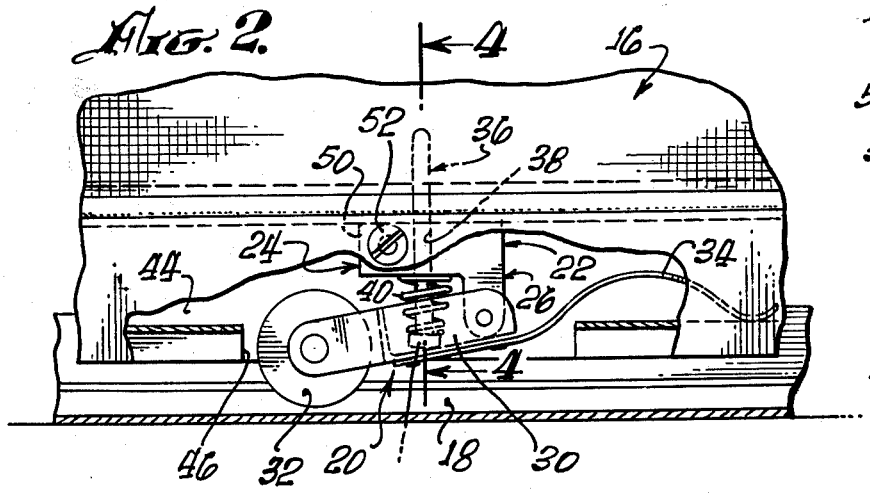
FIG. 2 is an enlargement of the area encircled by the arrow 2 in FIG. 1 with parts broken away for the sake of clarity.
Figure 4:
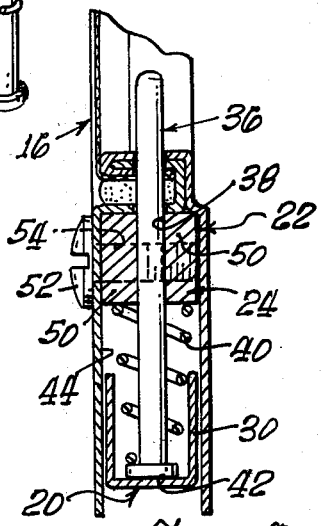
FIG. 4 is an enlarged section taken on line 4—4 in FIG. 2.
Figure 5:
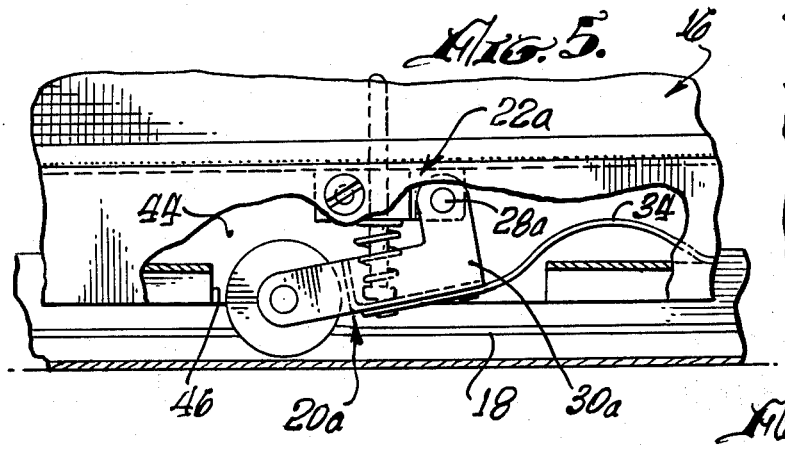
FIG. 5 is a view similar to FIG. 2 showing a somewhat modified roller assembly according to the invention.

The modified roller assembly 28 of FIG. 5 is similar to that of FIGS. 2 through 4 except that the depending arm 26 of the roller mounting brackets 22 is omitted from the roller mounting bracket 22*a* in FIG. 5 and the roller carrier arm 30 is replaced in FIG. 5, by a generally L-shaped arm 30*a* having an upstanding end which is pivotally attached by a pivot 28*a* to the modified roller mounting bracket 22*a*. Otherwise, the modified roller assembly 20*a* is identical to and operates in the same manner as the roller assembly 20.

Figure 6:
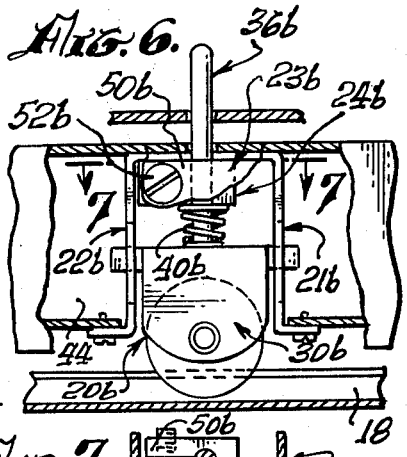
FIG. 6 illustrates a further modified roller assembly according to the invention.
Figure 7:
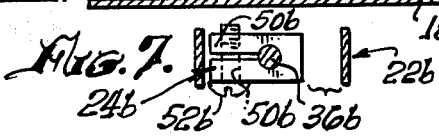
FIG. 7 is a sectional view taken at line 7—7 in FIG. 6.

The modified roller assembly 20*b* of FIGS. 6 and 7 comprises a basic roller structure 21*b* which is essentially identical to that shown in U.S. Pat. No. 3,698,036 and hence need not be described in elaborate detail. Suffice it to say that the basic roller structure 21b comprises a generally inverted U-shaped mounting bracket or strap 22b secured by screws within the bottom channel 44 of the sliding door panel 16, in the manner shown. Vertically movable in the bracket 22b is a carrier 30b for a roller 32b which rides on the lower door frame track 18. This basic roller structure as described to this point is identical to that described in U.S. Pat. No. 3,698,036.

According to the present invention, the mounting bracket 22b includes a split clamp block 24b within the upper end of the bracket, just below its upper cross member, through which and the cross member extends a limit stop plunger 36b for the roller carrier 30b. The plunger is urged downwardly toward the carrier by a spring 40b. The clamp arms 50b of the clamp block 24b straddle the limit stop plunger 36b, as in the other described forms of the invention, and are joined by a screw 52b for drawing the arms together to clamp the plunger in fixed position. This screw extends through a hole in a side wall of the door channel 44 so as to be accessible for clamping and releasing the limit stop plunger 36b.

The modified door supporting roller assembly 20b is adjusted essentially in the same manner as described earlier in connection with FIGS. 1 through 5. Thus, the movable door panel 16 is supported in a slightly raised position out of contact with the bottom of the door frame 12 with the clamp screw 52b released, whereby the force of the limit stop plunger spring 40b is exerted downwardly against the roller carrier 30b to retain the roller 32b in contact with the frame track 18. The clamp screw 52b is then tightened to firmly clamp the limit stop plunger 36b in fixed position. When the door panel 16 is released, the weight of the door panel is transmitted to the track 18 through the limit stop plunger 36b, the roller carrier 30b, and the roller 32b, as before.

The inventor claims:

1. A supporting roller assembly for a sliding door comprising:

a mounting bracket, a roller carrier, a peripherally grooved roller on said carrier, means mounting said carrier on said bracket for normally generally vertical movement of said carrier relative to said bracket, a limit stop plunger vertically movable in said bracket and engageable with said carrier to limit upward movement of said carrier relative to said bracket, a spring for urging said plunger toward said carrier to urge said carrier downwardly, said bracket comprising a pair of resilient clamp arms straddling said plunger, and a clamp screw joining said arms for drawing said arms together to firmly clamp said plunger in fixed position relative to said bracket.

2. A roller assembly according to claim 1, wherein:

said bracket comprises a block having a bore slidably receiving said limit stop plunger and a slit containing the axis of said bore and forming said clamp arms.

3. A roller assembly according to claim 2, wherein:

said slit enters one end of said bracket block, said carrier comprises an arm pivoted at one end on the other end of said block for normally vertical swinging movement of said carrier arm, said roller is mounted on the other end of said carrier arm, and a spring for urging said carrier arm downwardly about its pivot.

4. A roller assembly according to claim 3, wherein:

said mounting bracket is generally L-shaped and has a depending arm pivotally attached at its lower end to said carrier arm.

5. A roller assembly according to claim 3, wherein:

said carrier arm is generally L-shaped and has an upturned portion at said one carrier arm end pivotally attached at its upper extremity to said mounting bracket.

6. A roller assembly according to claim 1, wherein:

said bracket has a generally inverted U-shape and includes a normally upper clamp block having a bore slidably receiving said limit stop plunger and a slit containing the axis of said bore and forming said clamp arms, and said roller carrier is mounted on said bracket below said clamp block for vertical movement toward and away from said clamp block.

* * * * *